United States Patent [19]

Guim

[11] Patent Number: 4,573,604

[45] Date of Patent: Mar. 4, 1986

[54] TILT FREE CONTAINER

[76] Inventor: Raûl Guim, 834 Venetia, Coral Gables, Fla. 33134

[21] Appl. No.: 755,097

[22] Filed: Jul. 15, 1985

[51] Int. Cl.[4] ..... B65D 23/00

[52] U.S. Cl. ..... 220/69; 215/1 C; 215/12 R

[58] Field of Search ..... 220/69; 215/1 C, 100 R, 215/12 R

[56] References Cited

U.S. PATENT DOCUMENTS

| | | | |
|---|---|---|---|
| 3,613,761 | 10/1971 | Moody | 215/12 R X |
| 3,726,429 | 4/1973 | Doughty | 215/12 R X |
| 4,241,839 | 12/1980 | Alberghini | 215/1 C X |
| 4,331,246 | 5/1982 | Sörensen | 220/69 X |
| 4,367,820 | 1/1983 | Yoshino et al. | 220/69 X |
| 4,442,944 | 4/1984 | Yoshino et al. | 215/1 C |

*Primary Examiner*—Steven M. Pollard

[57] ABSTRACT

An improvement for conventional soda containers that have a bottle member with a rounded bottom resting on a cylindrical base. The improvement including a peripheral skirt positioned at a predetermined uniform distance from the rounded bottom so that the upper edge of the cylindrical base fits snuggly between the inner wall of the bottle thereby preventing any tilting or rocking of the bottle on its base. A rivet is integrally built in on the bottom of the bottle and, with a cooperating receiving hole in the base, provides a firm attachment between the bottle member and the base.

3 Claims, 3 Drawing Figures

TILT FREE CONTAINER

BACKGROUND OF THE INVENTION

1. Field of the Invention.

The present invention relates to improvements in containers and more particularly to improvements for containers that include a cylindrical base.

2. Description of the prior art.

Plastic containers for soda and other liquids have been designed containing a maximum of liquid with minimum weight. These conventional plastic containers are similar to the ones shown in the enclosed figures. These conventional containers include two parts, a cylindrical bottle and a base to which the cylindrical bottle is glued.

Problems with this structure arise when the glue is not properly applied, the heat causes it to run or for any other reasons a good bond is not achieved. When the containers are stacked up, the cylindrical bottles are tilted on their base eventually collapsing. Also, the containers must be straight to convey the commercial appeal desired by the producers.

The container disclosed and claimed in the present application solves this problem in an efficient and simple manner.

SUMMARY OF THE INVENTION

It is the main object of the present invention to provide a container that is sturdy easy to handle and wherein the bottle member does not tilt.

It is yet another object of the present invention to provide a container that can be manufactured inexpensively.

It is yet another object of this invention to provide a container that is similar to the conventional containers now in use.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
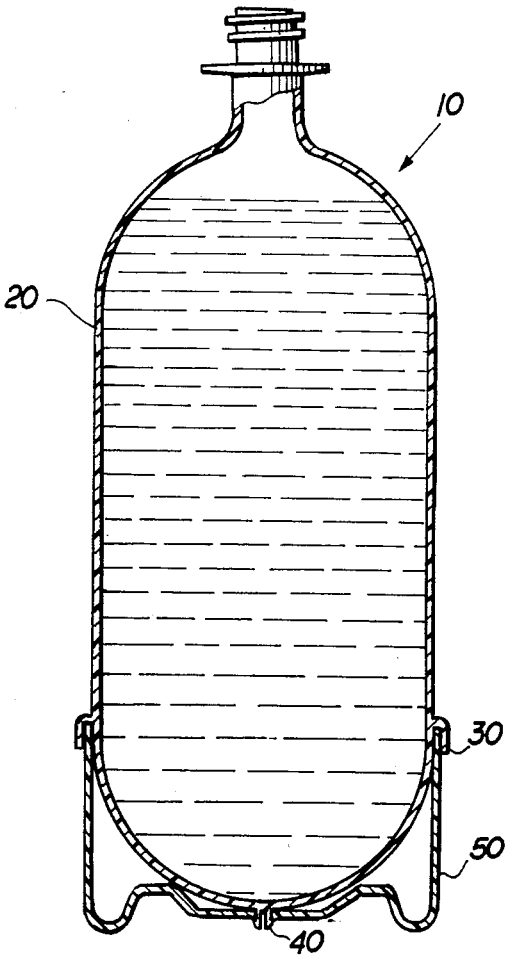
FIG. 1 represents a cross sectional view of the present container, including the bottle and base parts.

Referring now to FIG. 1, where the present invention, a tilt free container, is generally referred to by numeral 10, it can be observed that it includes, basically, a bottle member 20 and a cylindrical base member 50.

Figure 2:
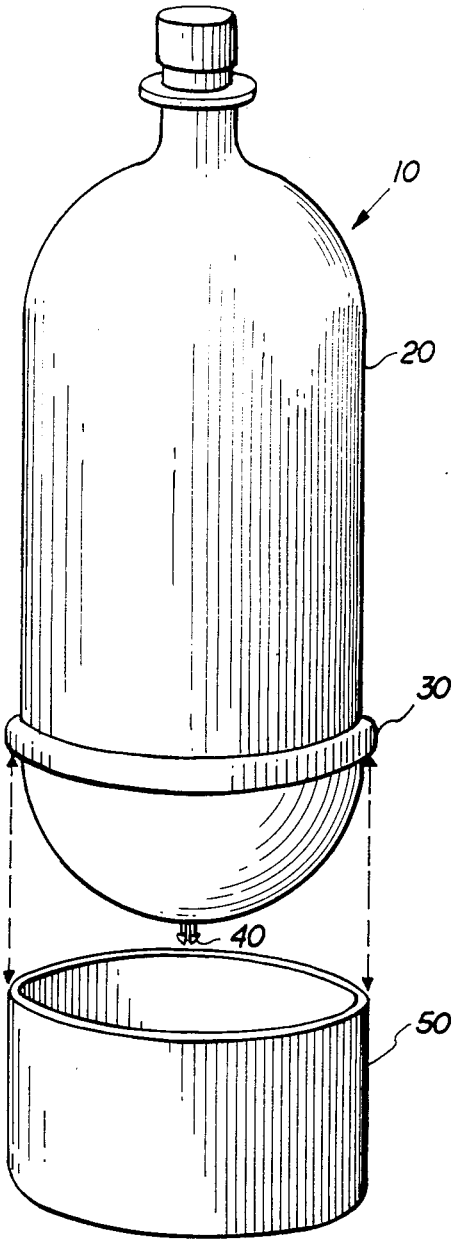
FIG. 2 shows the disassembled container.

Bottle member 20 has a substantially elongated shape with a peripherally extending skirt 30 positioned at a uniform distance from the bottom of bottle 20 that is sufficient to allow the upper edge of cylindrical base 50 to snuggly fit between the outer wall of bottle 20 and the inner wall of skirt 30. A one-way rivet 40 is integrally built in on the center of the round bottom of bottle 20, as shown in FIGS. 1 and 2.

Figure 3:
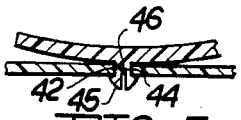
FIG. 3 illustrates a detail of the snap in rivet.

FIG. 3 shows a detail of the preferred embodiment for rivet 40 comprising bifurcated rivet stems 42 and 44 that are separated by clearance 46. Rivet 40 is made out of a resilient material that urges an elastic separation of stems 42 and 44. A cammed head 45 is provided at the end of stems 42 and 44 in order to facilitate the snap in action of head 45 through the base 50.

Bottle 20 is then held in place by rivet 40 that prevents bottle 20 from separating from base 50 and skirt 30 that prevents bottle 20 from tilting on base 50. Since skirt member extends peripherally around the bottle, it prevents any tilting action caused by the weight of the liquid in the containers or the stacking up of the containers.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. In a plastic container for liquids having a cylindrical bottle member having a rounded bottom and resting on a cooperating cylindrical base member, the improvement comprising:

a. skirt member peripherally mounted on said bottle member at a uniform predetermined distance from said bottom so that when said bottle member rests on said base member the upper edge of said base member fits snuggly between said skirt member and said bottle member thereby preventing any tilting movement of said bottle member;

b. rivet means mounted on said rounded bottom, downwardly extending; and c. a hole in said base member cooperatively positioned so as to receive said rivet means, thereby maintaining said bottle member attached to said base member.

2. The improvement set forth in claim 1 wherein said rivet means includes a pair of bifurcated stems, each having a cammed head at their ends so that the snap action in said hole is facilitated.

3. The improvement set forth in claim 2 wherein said rivet means is positioned in the center of said bottom.

* * * * *